United States Patent [19]

Dearwester

[11] Patent Number: 4,623,074

[45] Date of Patent: Nov. 18, 1986

[54] DUAL DISPENSING MODE CARTON AND CONCOMITANT PACKAGE

[75] Inventor: Donald D. Dearwester, Hamilton, Ohio

[73] Assignee: The Procter & Gamble Company, Cincinnati, Ohio

[21] Appl. No.: 704,831

[22] Filed: Feb. 25, 1985

[51] Int. Cl.[4] ..... A47K 10/24; B65H 1/00

[52] U.S. Cl. ..... 221/48; 221/55; 221/63; 206/494; 206/620

[58] Field of Search ..... 221/48, 63, 33, 47, 221/49–51, 55; 126/518; 206/449, 494, 812, 815, 824; 271/145; 229/7 R, 17 R

[56] References Cited

U.S. PATENT DOCUMENTS

| | | | |
|---|---|---|---|
| 2,118,380 | 5/1938 | Gresenz | 206/57 |
| 3,012,692 | 12/1961 | Petersen | 221/63 |
| 3,144,961 | 8/1964 | Phenner | 221/48 |
| 3,145,840 | 8/1964 | Wright | 206/449 X |
| 3,258,156 | 6/1966 | Smith | 206/449 X |
| 3,272,385 | 9/1966 | Watkins | 231/40 |
| 3,424,367 | 1/1969 | Desmond et al. | 221/63 |
| 3,456,844 | 7/1969 | Planner | 221/63 |
| 3,606,080 | 9/1971 | Lynch et al. | 221/63 |
| 3,918,608 | 11/1975 | Faller | 221/63 |
| 3,940,054 | 2/1976 | Goebel et al. | 221/63 |
| 3,982,685 | 9/1976 | Shimada | 206/494 X |
| 4,044,919 | 8/1977 | Olson | 221/63 |

FOREIGN PATENT DOCUMENTS

| | | | |
|---|---|---|---|
| 265079 | 10/1961 | Australia | 206/494 |
| 1017299 | 9/1977 | Canada | 221/63 |

*Primary Examiner*—Joseph J. Rolla
*Assistant Examiner*—P. McCoy Smith
*Attorney, Agent, or Firm*—Thomas J. Slone; Fredrick H. Braun; Richard C. Witte

[57] ABSTRACT

A dual dispensing mode carton for, for example, a stack of interfolded sheets of facial tissue. The carton has a dispensing opening which is configured and disposed to enable substantially droop-free pop-up dispensing of one sheet at a time with improved sheet to sheet stand-up height uniformity as successive sheets are withdrawn from the carton; and group mode dispensing of a plurality of sheets simultaneously without having to disassociate them from each other. A dispensing package is also provided which comprises such a dispensing carton having a stack of interfolded sheets disposed therein.

12 Claims, 11 Drawing Figures

201
202 PRIOR ART
AVERAGE POP-UP HEIGHT, INCHES
GROUPS OF TEN CONSECUTIVE TISSUES
5
4
3
2
0
0 10 20 30 40 50 60 70 80 90 100 110
TISSUE NUMBER IN SEQUENCE OF
POP-UP DISPENSING FROM CARTON 201
203 PRIOR ART
AVERAGE POP-UP HEIGHT, INCHES
GROUPS OF TEN CONSECUTIVE TISSUES
5
4
3
2
0
0 10 20 30 40 50 60 70 80 90 100 110
TISSUE NUMBER IN SEQUENCE OF
POP-UP DISPENSING FROM CARTON

DUAL DISPENSING MODE CARTON AND CONCOMITANT PACKAGEI

DESCRIPTION

1. Technical Field

This invention pertains to dispensing packages and cartons for interfolded sheet material such as, for example, facial tissues. More specifically, it pertains to such packages and cartons which are configured to enable two (i.e., dual) user-selected modes of dispensing of interfolded sheets through a single dispensing opening: substantially droop-free pop-up dispensing of one sheet at a time with improved sheet to sheet stand-up height uniformity as successive sheets are withdrawn from the carton; or group dispensing of a plurality of sheets without having to disassociate them.

2. Background Patents

Contemporary packages comprising stacks of sheet material inside cartonboard cartons are of two principal types: one type having the sheets interfolded to enable pop-up dispensing through an opening in the top wall of the carton; and another type wherein the sheets are not interfolded and wherein an opening is provided in the carton to enable removal of one or more sheets at a time but not providing pop-up dispensing of successive sheets (i.e., not providing partial withdrawal of the next successive tissue upon pulling sheets one at a time from the carton). However, U.S. Pat. Nos. 3,144,961 and 3,272,385 which are discussed below do in fact purport to disclose dispensing packages for sheet products such as facial tissues wherein interfolded sheets may be pop-up dispensed one at a time or plural tissues may be dispensed as a group without having to disassociate them from each other. While these patents have addressed some of the problems associated with providing both pop-up and plural dispensing from the same carton, they have not solved the problems in a manner of nor to the extent of the present invention.

U.S. Pat. No. 3,144,961 which issued Aug. 18, 1964 to L. E. Phenner discloses a Tissue Dispensing Carton With Floating Control Element. The disclosed carton has a composite dispensing opening which comprises a narrow elongate slot in the top wall and a vertical slot in the front wall which slots are connected by a trapezoidal-shape transition zone in the top wall. The floating control element has a composite opening that is substantially identically shaped but slightly smaller than the combination of the elongate slot and trapezoidal-shape transition zone in the top wall of the carton. An important object of the invention is expressly stated to be providing an improved carton from which individual tissues may sequentially be dispensed, and from which a plurality of tissues may be conveniently removed as a unit. Tests of such cartons containing commerical interleaved facial tissue (i.e., Posh Puffs, a registered trademark of the Procter & Gamble Co., and Kleenex, a registered trademark of Kimberly-Clark Corporation) have disclosed that as compared to the present invention, a very high percentage of popped-up tissues in such cartons not having floating control members droop or lay over on the cartons rather than standing erect; and, stand-up height progresssively diminishes in such cartons having floating control members as tissues are dispensed due, apparently, to the weight of the control member falling back and thereby at least partially retracting the next-to-be-dispensed tissue after the just dispensed tissue has been disengaged therefrom.

Additionally, as is described more fully hereinafter, such cartons having such control members as well as those without precipitate substantially greater tissue-to-tissue stand-up-height variance than embodiments of the present invention.

U.S. Pat. No. 3,272,385 which issued Sept. 13, 1966 to C. H. Watkins discloses a Dispenser Box having a hinged member through which pop-up dispensing may be effected but which panel must be hinged out of the way (i.e., out of the box) to effect group dispensing.

In addition to the above discussed cartons which may provide, at least to some extent, dual mode dispensing, U.S. Pat. No. 2,118,380 which issued May 24, 1938 to W. A. Gresenz discloses a Package For Sheet Material which apparently is intended to only provide sequential dispensing of one sheet at a time. The package comprises a carton and a bundle of interleaved tissues. A dispensing opening is provided in the carton which comprises an elongate slot in the top wall which slot has an edge that is coextensive with the top-front edge of the carton; and a slot in the front wall of the carton. As tissues are sequentially dispensed from such cartons, the leading portion of the next tissue lies across the top-front edge of the carton. That is, the tissues droop on the carton as droop is defined herein; and, as compared to the present invention, the sheets have no appreciable stand-up height as that term is also defined herein.

DICLOSURE OF THE INVENTION

In accordance with one aspect of the invention, a dispensing carton for interfolded sheets is provided that comprises means for enabling selective dual mode dispensing of sheets through a single opening in a stationary wall portion of the carton. One mode is substantially droop-free pop-up dispensing of one sheet at a time with highly uniform sheet to sheet stand-up height. The second mode is group mode dispensing of a plurality of sheets as a group without having to disassociate them from each other. Such a carton is preferably parallelepipedal-shape, and has a mushroom-shape dispensing opening that is configured and disposed to be sufficiently symmetrically constrictive with respect to front-fold and back-fold tissues (i.e., U-folded tissues having their folded edge adjacent the front wall and the back wall, respectively, of the carton) to provide relatively droop-free pop-up dispensing with uniform sheet to sheet stand-up height; and sufficiently open to enable removal of plural sheets as a group without having to disassociate them from each other. The dispensing opening preferably comprises an elongate head portion that is centrally disposed in the top wall of the carton; a stem portion which extends downwardly through a medial portion of the front wall of the carton; and a flared portion having arcuate edges disposed intermediate the head and stem portions. The elongate head portion is preferably substantially elliptical-shape; has its major axis coextensive with the lengthwise centerline of the top wall of the carton; is from about sixty to about eighty percent as long as the carton; and has a width of from about fifteen to about thirty percent of the length of the head portion. Additionally, preferably, the stem portion of the dispensing opening has parallel side edges, and extends into the top wall of the carton whereby the forward end of the flared portion is spaced rearward from the top-front edge of the carton. The dispensing opening may indeed be provided per se in the carton at the time of manufacture or, alternatively be a tear out panel defined by a line of weakening. Additionally, the perimeter of the dispensing opening is preferably a continuously curved lineament; and, in particular, in conjunction with the back edge of the head portion being elliptically curved, the ends of the head portion are radiused to cause the longitudinal edge portions of tissues being withdrawn to curl in such manner (e.g., vertically extending semi-cylindrical rolled edges) as to impart substantial columnar strength to the portion of the tissue which extends above the top wall of the carton after the next previous tissue has been fully removed and disassociated therefrom. In other aspects of the invention, dispensing packages are provided with comprise such cartons containing bundles of interfolded tissues.

BRIEF DESCRIPTIONS OF THE DRAWINGS

While the specification concludes with claims which particularly point out and distinctly claim the subject matter regarded as forming the present invention, it is believed the invention will be better understood from the following descriptions taken in conjunction with the accompanying drawings in which identical features in the several views are identically designated and in which:

DETAILED DESCRIPTION OF THE INVENTION

Figure 1:
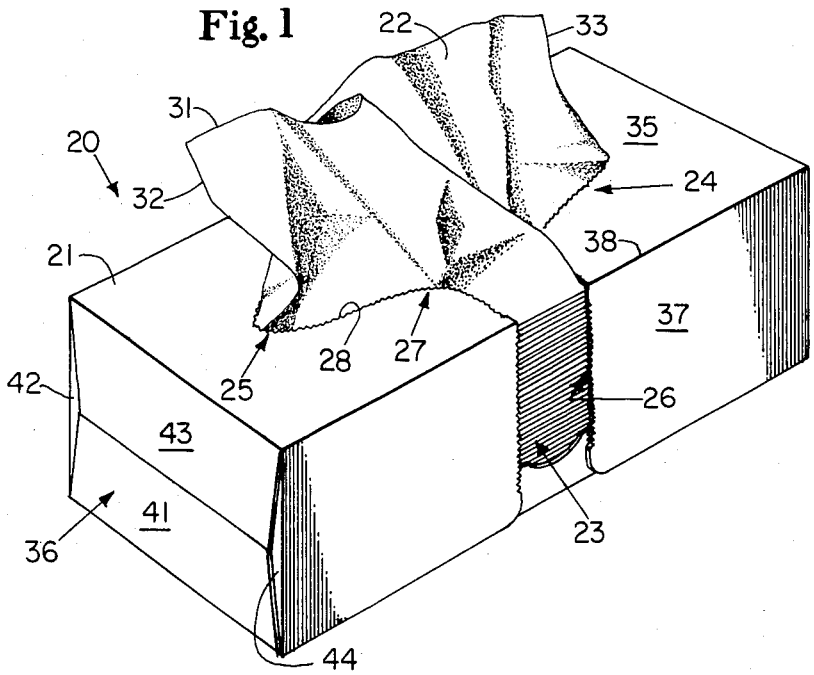
FIG. 1 is a perspective view of a facial tissue package embodiment of the present invention wherein a partially withdrawn tissue extends upwardly through the dispensing opening of the carton.
Figure 2:
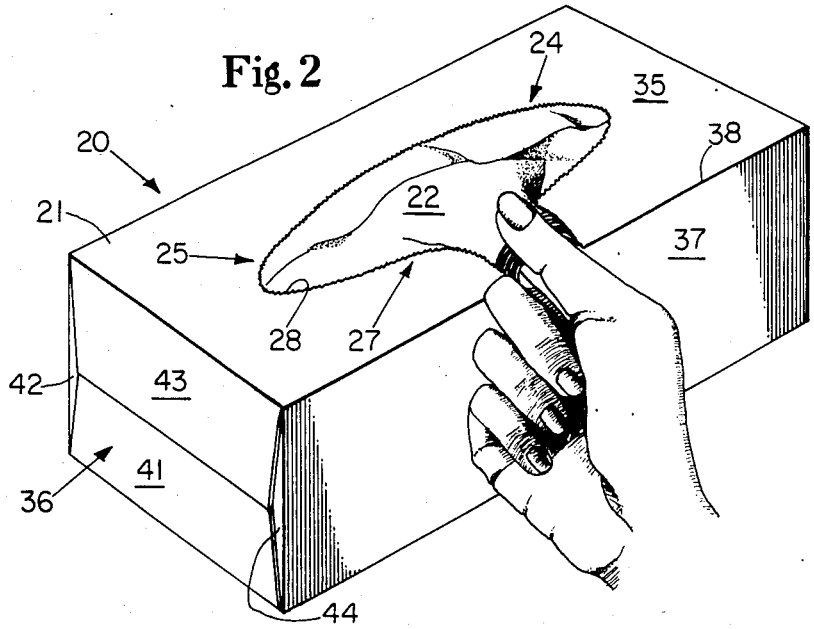
FIG. 2 is another perspective view of a facial tissue package embodiment of the present invention which view depicts initiation of withdrawal of a group of tissues as a unit from the carton.

An exemplary package 20 which is a preferred embodiment of the present invention is shown in FIG. 1 to comprise a carton 21 containing a bundle 23 of sheets 22 of facial tissue paper. The carton 21 is provided with a dispensing opening 24 which is a composite having a generally mushroom-shape which comprises an elliptical head portion 25, a stem portion 26, and a flared portion 27. The perimeter of the dispensing opening is designated lineament 28. Preferably, lineament 28 is smoothly curved throughout its length. Among other things, this enables tear-out removal of a panel that has been outlined by a line of weakening having the configuration of lineament 28. As shown in FIG. 1, the topmost visible tissue 22 is partially withdrawn from carton 21, and its edges which are visible in FIG. 1 are designated leading edge 31, and longitudinal side edges 32 and 33. Also as shown in FIG. 1, carton 21 comprises top wall 35, end wall 36, and front wall 37; and the top-front edge of the carton is designated 38. FIG. 2 depicts grasping a group of tissues 22 between the thumb and forefinger of a hand to remove the group as a unit from carton 21 through the dispensing opening 24.

Briefly, referring back to FIGS. 1 and 2, the tissues 22 of bundle 23 are U-folded and interleaved to enable pop-up dispensing of one tissue at a time. Dispensing opening 24 is so configured and disposed so that removal of one tissue at a time causes the leading edge portion of the next successive tissue to stand up away from the carton: that is, to not droop or lie on the top wall of the carton. Furthermore, the configuration and disposition of dispensing opening is such that there is little sheet to sheet variation in stand-up height of successive tissues; and a plurality of tissues may be removed as a group without having to disassociate them from each other. While not wishing to be bound by a theory of operation, it is believed that limiting the length of the head portion of dispensing opening 23 to the range of from about sixty to about eighty percent of the length of the carton, and radiusing the ends thereof as further described herein causes the longitudinal edge portions of tissues being withdrawn to curl in such a manner as to impart substantial columnar strength to the portion of the tissue which extends above the top wall of the carton after the next previous tissue has been fully removed and disassociated therefrom. That is, it is believed that shaping and positioning the dispensing opening as disclosed herein precipitates tissue shapes having sufficient columnar strength to substantially obviate drooping as herein defined.

Figure 3:
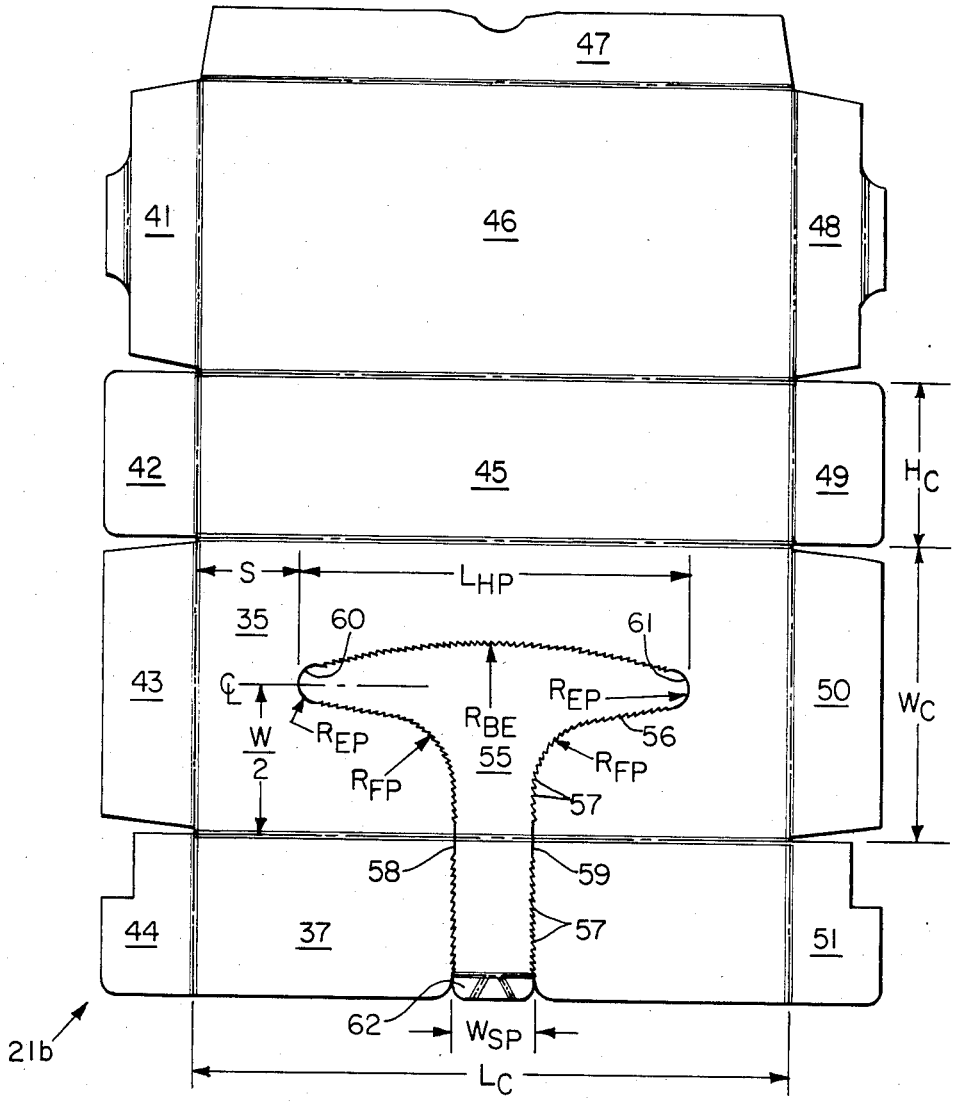
FIG. 3 is a plan view of a cut and scored cartonboard blank from which, when erected, becomes a carton of the configuration shown in FIGS. 1 and 2.

FIG. 3 is a plan view of a carton blank **21*b* that is cut and scored to enable it being erected and converted into carton 21, FIGS. 1 and 2. As shown in FIG. 3, carton 21 comprises top wall 35, front wall 37, end flaps 41–44 which corporately make up end wall 36, FIG. 1, back wall 45, bottom wall 46, front glue flap 47, and end flaps 48–51. Additionally, carton 21 comprises a tear-out panel 55 which is defined by a line of weakening 56 having the shape of lineament 28, FIG. 1. Further, the radius of the back edge of the tear-out panel 55 (i.e., the back edge of dispensing opening 24, FIG. 1) is designated $R_{BE}$; the radii of the ends of head portion of panel 55 are designated $R_{EP}$;the radii of the flared portion are designated $R_{FP}$; the lengths of the head portion of panel 55 and the top wall 35 (i.e., length of Carton 21, FIG. 1) are designated $L_{HP}$ and $L_C$, respectively; $W_C$ and $H_C$ indicate the width (i.e., front to back dimensions and height of Carton 21, FIG. 1); and $W_{SP}$ indicates the width of the stem portion of tear-out panel 55 (i.e., the stem portion 26, FIG. 1, of the dispensing opening 24, FIG. 1). The head portion of the tear-out panel 55 is equally spaced a distance S from each side edge of the top wall 35. As still further indicated in FIG. 3, while most of the edge of tear-out panel 55 comprises very short and closely spaced cuts 57, longer cuts 58 and 59 extend over the coextensive edges of top panel 35 and front panel 37, and the radii $R_{EP}$ are cuts 60, 61. Cuts 58**, 59, 60 and 61 are provided to insure clean removal of panel 55 inasmuch as short spaced cuts in such areas could render it more difficult to remove panel 55. Additionally, the bottom end of the stem portion of the tear-out panel is configured to be a pull tab and is accordingly designated pull-tab 62.

Figure 4:
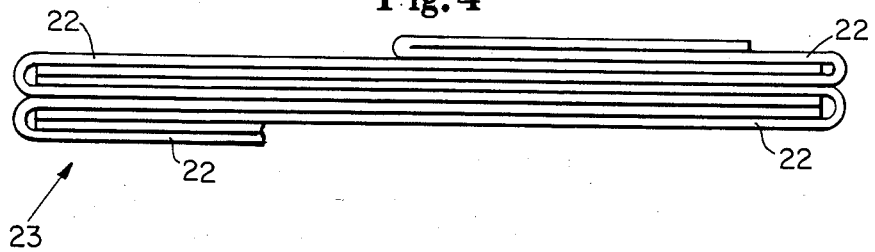
FIG. 4 is an enlarged scale, end elevational view of the top few tissues of a bundle of U-interleaved facial tissues such as may be included in the package shown in FIGS. 1 and 2, and wherein the thickness of the tissues are greatly exaggerated for clarity.

FIG. 4 simply indicates the U-folded tissues 22 of bundle 23, and their interleaved association.

An exemplary embodiment of package 20, FIG. 1 comprises a carton 21 that is sized and configured to accommodate a bundle of about one-hundred-fifty tissues 22. Such a carton is made from twenty two point cartonboard and has, referring to FIG. 3, the following approximate dimensions: $L_C$ about nine-and-seven-eighths inches (about 25 cm); $L_{HP}$ about six-and-one-half inches (about 16.5 cm); $W_C$ about four-and-three-quarters inches (about 12 cm); $W_{SP}$ about one-and-five-sixteenths inches (about 3.3 cm); S about one-and-eleven-sixteenths inches (about 4.3 cm); $R_{BE}$ about ten-and-one-quarter inches (about 26 cm); $R_{FP}$ about one-and-twenty-seven-thirty-seconds inches (about 4.7 cm); and $R_{EP}$ about nine-thirty-seconds inch (about 0.7 cm). Additionally, short straight line segments which closely approximate segments of the ellipse defining the head portion are provided between the $R_{EP}$ segments and the $R_{FP}$ segments of the lineament.

Figure 5:
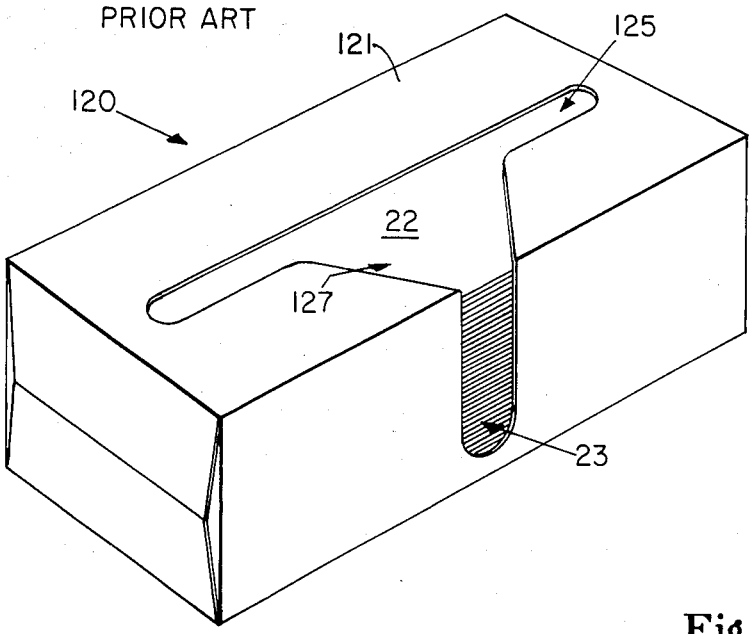
Fig. 5 PRIOR ART
FIG. 5 is a perspective view of a prior art dispensing package.
Figure 6:
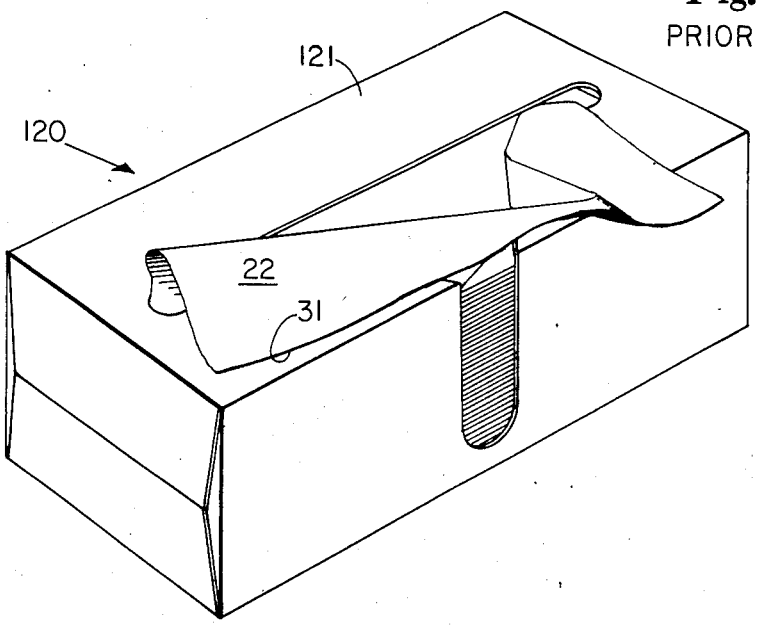
Fig. 6 PRIOR ART
FIG. 6 is a perspective view of the prior art dispensing package of FIG. 5 wherein a partially withdrawn tissue is shown drooped forward and lying on the front portion of the top wall of the carton.

FIGS. 5 and 6 are perspective views of a Prior Art package 120 of facial tissues 22 in a carton 121. Such a package is disclosed in U.S. Pat. No. 3,144,961, described hereinbefore. Briefly, its dispensing opening comprises a relatively long and narrow portion 125 which is centrally disposed in the top wall of the carton; and a trapezoidal-shape transition zone 127. All of the major edge portions are straight and, as compared to the present invention, intersect at relatively sharp corners. As disclosed in U.S. Pat. No. 3,144,961, such cartons are fitted with floating inserts (not shown) to promote reliable pop-up dispensing: particularly so from deep cartons.

Figure 7:
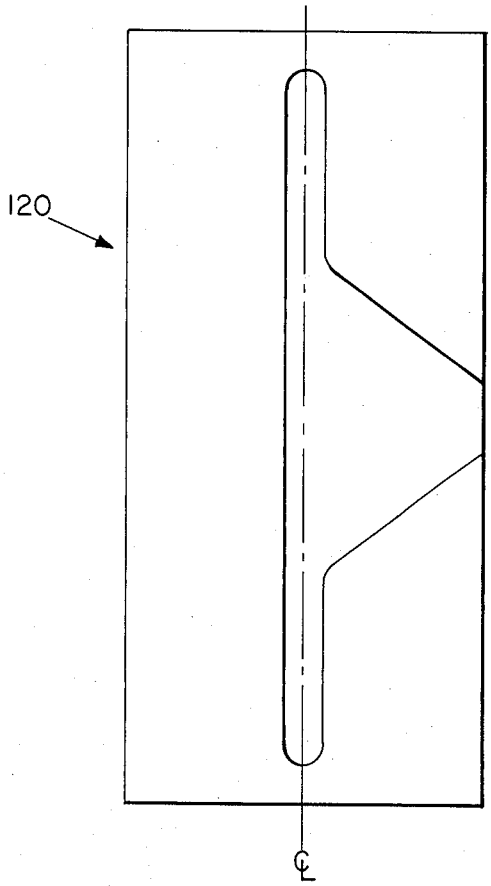
Fig. 7 PRIOR ART
FIGS. 7 and 8 are reduced scale, plan and end views, respectively, of the prior art carton of FIG. 5.
Figure 8:
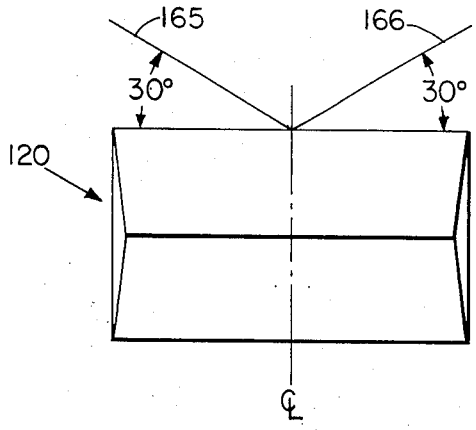
Fig. 8 PRIOR ART

FIGS. 7 and 8 are plan and end elevational views of a prior art carton of the configuration disclosed by Phenner in U.S. Pat. No. 3,144,961. The plan view shows the elongate portion of the dispensing opening to be centered on the centerline of the carton. Droop-planes 165 and 166 are shown in FIG. 8 to be at thirty degree inclinations with the top wall of the carton and each extending upwardly and outwardly from the position of the centerline in the top wall of the carton.

Before discussing the pull tests which were conducted, and the data which resulted therefrom, the terms "droop" and stand-up (or pop-up) height will be defined.

With respect to "droop" as used herein, the next tissue to be dispensed (i.e., the portion which extends above the top wall of the carton) is said to droop when either of the following conditions exists:

1. When all of its leading edge 31 (FIG. 1) is below either droop-plane as described above; and/or
2. When either a continuous length portion or plural discontinuous length portions which total at least fifty percent of the length of the tissue (its dimension parallel to the length of the carton) lie on the top wall of the carton.

Stand-up height (alternatively referred to herein as pop-up height) is the vertical elevational difference between the highest portion of the upwardly extending tissue and the top wall of the carton.

Drop-ins are next-successive tissues which fall back inside the carton after completing the dispensing of the next prior tissues.

TESTS

Pull-tests (i.e., pop-up dispensing of one tissue at a time) were conducted by two persons: one who methodically pulled straight-up in the center spans of the tissues at modest rates; and another who preferred to essentially jerk each tissue from the cartons. The tests involved full cartons 21 of the exemplary dimensions stated above, as well as prior art cartons of the Phenner configurations. Two species of Phenner were tested: with inserts and without inserts. These are hereinafter referred to as PHENNER/INSERT and PHENNER/NO INSERT. Additionally, each test carton configuration was tested using bundles of interfolded tissues from commercially procured POSH PUFFS (registered trademark of The Procter & Gamble Company) and Kleenex (registered trademark of Kimberly-Clark Corporation). Some of these data are tabulated in Table 1, below; and other data are graphed in FIGS. 9–11.

TABLE 1

| | | PHENNER | |
|---|---|---|---|
| | Carton 21 | INSERT | NO INSERT |
| Average Stand-Up Height, Inches | 4.63 | 3.39 | 2.80 |
| Percent Droops | 3 | 20 | 58 |
| Percent Drop-Ins | 0 | 2 | 2 |
| Percent Tears | 0 | 2 | 1 |
| No. of Tissues Dispensed | 470 | 470 | 470 |

Figure 9:
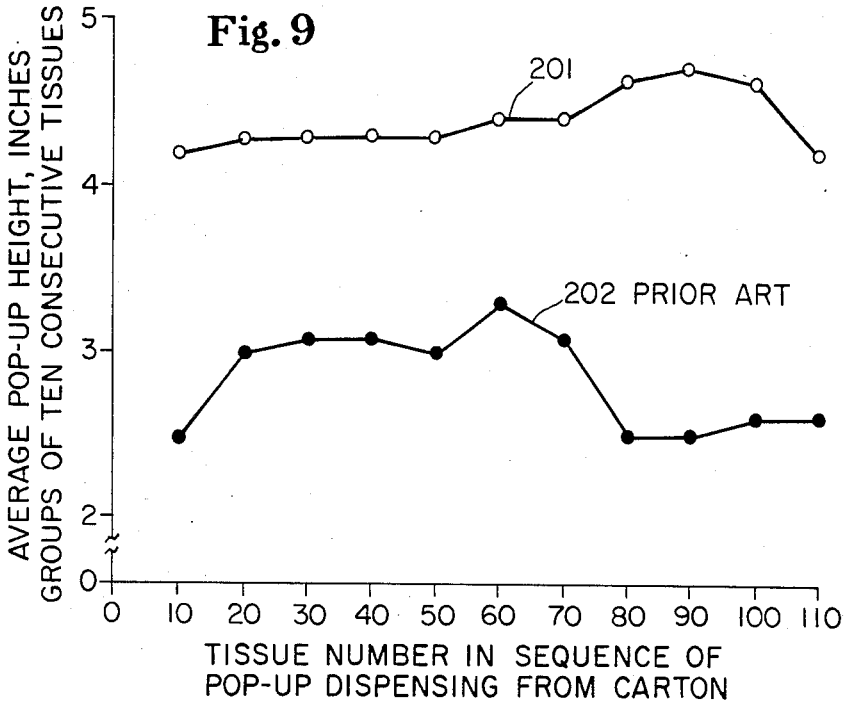
FIGS. 9 and 10 are graphs of comparative groups-often average pop-up height (i.e., stand-up height) variance data derived from embodiments of the present invention and prior art embodiments.
Figure 10:
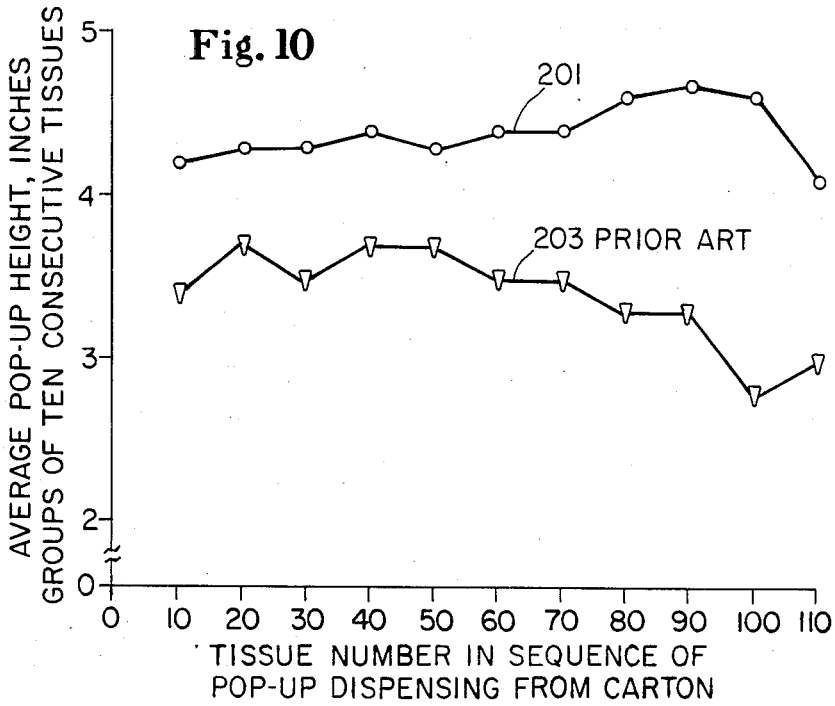

The FIG. 9 graph presents pull-test data that was generated as described above but which data was processed in groups of ten consecutive pulls (e.g., pull 1–10, 11–20, 21–30) for each puller and for each of the two brands of tissue to develop group averages. Therefore, each point on each curve on the graphs of FIGS. 9 and 10 is, in fact, a forty point average: ten pulls for each of two pullers from a test carton containing Posh Puffs tissues, and a test carton containing Kleenex tissues. Such data from embodiments of the present invention is designated in FIG. 9 as curve 201, and such data from PHENNER/NO INSERTS is designated on FIG. 9 as curve 202 (Prior Art). Similarly, the FIG. 10 graph presents such group averaged data from the present invention (curve 201 repeated from FIG. 9), and curve 203 from PHENNER/INSERTS. While not intending to limit the present invention by drawing conclusions from the graphs of FIGS. 9 and 10, it is clear that the average stand-up heights of tissues in package embodiments of the present invention are consistently substantially greater than either Phenner configuration: i.e., PHENNER/NO INSERTS, FIG. 9; and PHENNER-/INSERTS, FIG. 10.

Figure 11:
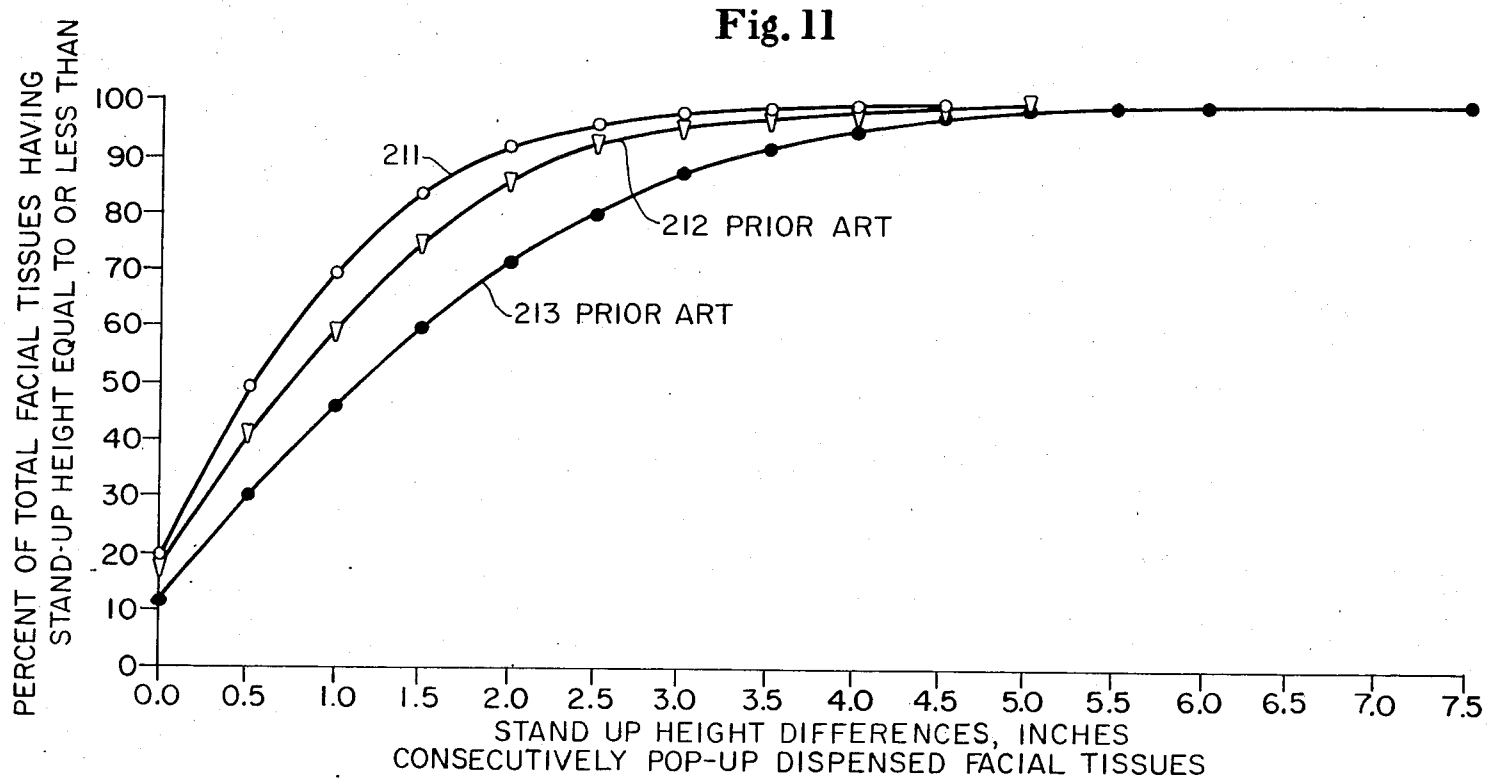
FIG. 11 is a graph of comparative tissue-to-tissue pop-up height variance data derived from embodiments of the present invention and prior art constructions.

Whereas, for FIGS. 9 and 10, stand-up height data from groups of ten consecutive pulls were averaged, the graph of FIG. 11 is based on tissue-to-tissue stand-up height differences. That is, the height differences between tissues 1 and 2, 2 and 3, 3 and 4, etc. were measured. This was also done for each of the two pullers for each of the brands of tissue. Thus, four height differences between tissues 1 and 2 were measured. All of these points were then grouped: i.e., the percent having tissue-to-tissue height differences of one-half inch or less; one inch or less; one-and-one half inches or less;

and so on. These grouped data for embodiments of the present invention are plotted on the graph of FIG. 11 and the curve drawn therethrough is designated 211. Similarly, curves 212 and 213 were derived from PHENNER/INSERTS and PHENNER/NO INSERT embodiments. These data show that the present invention provides substantially greater tissue-to-tissue stand-up height uniformity than the prior art emdodiments having inserts (curve 212) and those not having inserts (curve 213).

While particular emdodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dispensing carton for interfolded sheets which carton comprises integral stationary means for enabling selective dual mode dispensing of said sheets through a single dispensing opening in a stationary wall portion of said carton: substantially droop-free pop-up dispensing of one sheet at a time, or group mode dispensing of a plurality of sheets as a group without having to disassociate them from each other, said carton being sized to contain a bundle of interfolded sheets, said carton having top, front, rear, bottom and end walls, said means for selective dual mode dispensing comprising means for defining a mushroom-shape dispensing opening comprising an elongate head portion which is centrally disposed in said top wall of said carton and which has a non-linear back edge, a stem portion which extends downwardly through a medial portion of said front wall of said carton, and a flared portion having arcuate edges disposed intermediate said head portion and said stem portion, said opening being configured to be sufficiently constrictive with respect to withdrawing single sheets therethrough to enable substantially droop-free pop-up dispensing of one sheet at a time, and sufficiently non-constrictive to enable withdrawal of a plurality of said interfolded sheets as a group without having to disassociate them from each other, and said head portion being so disposed that its major axis is coextensive with the lengthwise centerline of said top wall.

2. The dispensing carton of claim 1 wherein said sheets are facial tissues, and said head portion of said dispensing opening is substantially elliptical-shape.

3. The dispensing carton of claim 1 wherein the length of said head portion is from about sixty to about eighty percent of the length of said carton, and said head portion has a minor axis length of from about fifteen to about thirty percent of the length of said major axis; said stem portion having generally parallel side edges which are spaced apart a distance of from about ten percent to about twenty percent of the length of said carton; and said flared portion having a width at its flared intersection with said head portion of from about thirty to about fifty percent of the length of said carton, and having a radius of from about fifteen to about twenty percent of the length of said carton.

4. The dispensing carton of claim 1 wherein said stem portion intersects the juncture between said front wall and said top wall, and extends orthogonally into said top wall therefrom whereby the intersection of said stem portion and said flared portion is spaced from the juncture of said front wall with said top wall.

5. The dispensing carton of claim 1 wherein said means for defining said dispensing opening is a smoothly contoured cut edge about the entire perimeter of said dispensing opening.

6. The dispensing carton of claim 1 wherein said means for defining said dispensing opening is a smoothly contoured removable panel.

7. A dispensing package for interfolded sheets, said package comprising a bundle of interleaved said sheets and a dispensing carton, said carton comprising integral stationary means for enabling selective dual mode dispensing of said sheets through a single dispensing opening: substantially droop-free pop-up dispensing of one sheet at a time, or group mode dispensing of a plurality of said sheets as a group without having to disassociate them from each other, said carton having top, front, rear, bottom and end walls, said means for selective dual mode dispensing comprising means for defining a mushroom-shape dispensing opening comprising an elongate head portion which is centrally disposed in said top wall of said carton and which has a non-linear back edge, a stem portion which extends downwardly through a medial portion of said front wall of said carton, and a flared portion disposed intermediate said head portion and said stem portion, said opening being configured to be sufficiently constrictive with respect to withdrawing single sheets therethrough to enable substantially droop-free pop-up dispensing of one sheet at a time, and sufficiently non-constrictive to enable withdrawal of a plurality of said interfolded sheets as a group without having to disassociate them from each other, and said head portion being so disposed that its major axis is coextensive with the lengthwise centerline of said top wall.

8. The dispensing package of claim 7 wherein said sheets are facial tissues, and said head portion of said dispensing opening is substantially elliptical-shape.

9. The dispensing package of claim 7 wherein the length of said head portion is from about sixty to about eighty percent of the length of said carton, and said head portion has a minor axis length of from about fifteen to about thirty percent of the length of said major axis; said stem portion having generally parallel side edges which are spaced from about ten percent to about twenty percent of the length of said carton; and said flared portion having a width at its flared intersection with said head portion of from about thirty to about fifty percent of the length of said carton, and having a radius of from about fifteen to about twenty percent of the length of said carton.

10. The dispensing package of claim 7 wherein said stem portion intersects the juncture between said front wall and said top wall, and extends orthogonally into said top wall therefrom whereby the intersection of said stem portion and said flared portion is spaced from the juncture of said front wall with said top wall.

11. The dispensing package of claim 7 wherein said means for defining said dispensing opening is a smoothly contoured cut edge about the entire perimeter of said dispensing opening.

12. The dispensing package of claim 7 wherein said means for defining said dispensing opening is a smoothly contoured removable panel.

* * * * *